US006598887B2

(12) United States Patent
Haldemann

(10) Patent No.: US 6,598,887 B2
(45) Date of Patent: Jul. 29, 2003

(54) IN-LINE ROLLER SKATES WITH BRAKING DEVICE

(76) Inventor: Gaston Haldemann, Sattelboden 12, Engelberg (CH), 6390

( * ) Notice: Subject to any disclaimer, the term of this patent is extended or adjusted under 35 U.S.C. 154(b) by 0 days.

(21) Appl. No.: 09/932,008

(22) Filed: Aug. 17, 2001

(65) Prior Publication Data

US 2001/0054803 A1 Dec. 27, 2001

Related U.S. Application Data

(63) Continuation of application No. PCT/CH00/00098, filed on Feb. 23, 2000.

(30) Foreign Application Priority Data

Feb. 24, 1999 (CH) ..... 0339/99

(51) Int. Cl.[7] ..... A63C 17/14

(52) U.S. Cl. ..... 280/11.221; 280/11.211; 280/11.204; 188/17

(58) Field of Search ..... 280/11.221, 11.19, 280/11.204, 11.205, 11.207, 11.211, 11.214, 11.231; 188/17, 265, 74, 29, 51

(56) References Cited

U.S. PATENT DOCUMENTS

| | | | | | |
|---|---|---|---|---|---|
| 5,143,387 | A | * | 9/1992 | Colla | 280/11.207 |
| 5,171,032 | A | * | 12/1992 | Dettmer | 280/11.212 |
| 5,351,974 | A | * | 10/1994 | Cech | 280/11.212 |
| 5,403,021 | A | | 4/1995 | Shifrin | |
| 5,415,419 | A | * | 5/1995 | Bourque | 280/11.214 |
| 5,752,707 | A | * | 5/1998 | Cottle et al. | 280/11.214 |
| 5,772,220 | A | * | 6/1998 | Gaster | 280/7.1 |
| 5,772,221 | A | * | 6/1998 | Daley | 280/11.204 |
| 5,779,245 | A | * | 7/1998 | Smith et al. | 280/11.204 |
| 5,908,197 | A | | 6/1999 | Strothmann et al. | |
| 6,010,136 | A | * | 1/2000 | Hoskin | 280/11.214 |
| 6,164,668 | A | * | 12/2000 | Majeski | 280/11.214 |
| 6,446,982 | B1 | * | 9/2002 | Gaster et al. | 280/11.205 |

FOREIGN PATENT DOCUMENTS

| | | | | |
|---|---|---|---|---|
| DE | 19730115 | | 7/1999 | |
| DE | 19730115 | A1 * | 7/1999 | A63C/17/14 |

* cited by examiner

*Primary Examiner*—Brian L. Johnson
*Assistant Examiner*—Kelly E Campbell
(74) *Attorney, Agent, or Firm*—Baker Botts L.L.P.

(57) ABSTRACT

An in-line roller skate with a braking device including a certain number of wheels (11) disposed longitudinally between two plates of a frame (22) of the skate. A control lever (1) articulated at the rear of the boot about a pivot shaft (19) can be actuated by a backward movement of the skate cuff. When rotating, the lower part (2) of the lever (1) pushes a rod (3) forwards and lengthways against return means **(10*a*, 10*b*), said rod carrying brake pads (5) in an equal number to the number of the discs (6) placed on the wheels 8 (11) and ramps (7*a*, 7*b*)** co-operating with complementary parts of the frame guiding the rod in order, during a forward movement, to bring the pads into contact with an upper part of the rotating discs. The ramps are positioned between two wheels so as to assure gentle and gradual braking.

14 Claims, 7 Drawing Sheets

IN-LINE ROLLER SKATES WITH BRAKING DEVICE

CROSS-REFERENCE TO RELATED APPLICATIONS

This application is a continuation of international application Serial No. PCT/CH00/00098 filed Feb. 23, 2000 and published on WO 00/50132 in French, which further claims priority to Swiss application Serial No. CH 0339/99, filed Feb. 24, 1999.

BACKGROUND OF THE INVENTION

The present invention concerns in-line roller skates, i.e. with all the wheels disposed in a line lengthways, provided with a braking device which can be actuated by a movement of the cuff of the skate boot or by the skater's leg.

Given that braking roller skates cannot, as a rule, occur in the same manner as braking on the side with an ice skate boot because of the risk of damaging the bearings of said wheels, a braking device preferably has to be added. Without such a braking device, the user of the skates has to brake by turning sharply and steeply which is similar to slowing down making the braking distance quite long, or by T braking with the rubber of the wheels by dragging one of the skates behind in a transverse position with respect to the direction of movement of the skate. It is clear that T braking does not require any particular mechanism, but it can only be used at relatively low speeds and also rapidly wears out the wheels while still having a long braking distance.

The braking device is usually placed on one of the two skates so as to be able to brake for example by placing one leg in front of the other, i.e. like scissors. The device acts directly on the wheels or on the ground.

One example of a currently used braking device consists in placing at the front or back of the skate an elastomeric pad so that it comes into contact with the ground to brake. Mounting such pads is common, since they are inexpensive. However, the fact of braking via pressure on the ground with an elastomeric pad is not very comfortable and the braking distance to a complete stop is relatively long.

Other braking device embodiments, which have mostly been protected by a patent, have been proposed without however being perfectly suited to roller skating.

One of the embodiments consists in a device braking all the wheels of both skates which includes discs secured to the frame placed on the outer sides between the wheels and the frame. By positioning the legs in an X with both feet parallel and perpendicularly to the line of skating, the wheels move laterally against the discs and cause braking. This method has a serious drawback, since positioning the legs in an X does not allow the stability required at the moment of braking to be improved. The only way to brake with sufficient stability being to place the legs in a scissor position which is not permitted by such a device.

U.S. Pat. No. 5,411,276 discloses, for example, an embodiment wherein the user brakes on a lateral surface of the two back wheels of one of the in-line skates with a brake actuated by a control lever which is manually actuated and connected by cable to the skate brake rod assembly. One drawback of this embodiment lies essentially in the fact that the skater has to permanently hold the control lever in his hand to be able to make the skates brake which also only works on the rolling surface of the rear wheels.

In place of such a braking control lever, an improvement to this control has consisted in providing one of the skates with a control lever, placed on the rear of the skate. When the skate boot is inclined backwards, the lever swings acting on a brake rod assembly placed on the frame of the skate to brake.

WO Patent No. 98/40133 discloses such a braking device wherein a rod includes openings housing the wheels and is placed on the axle of said wheels. The rod is pushed forwards against return means by a lever articulated on the rear of the boot so that the edges of the openings come into direct contact with the rolling surface of the wheels. A major drawback of having to brake by direct contact on the wheel lies in the fact that significant heating tends quickly to damage the wheels which are themselves already sufficiently subjected to wear via their contact with the ground.

In order to avoid having to brake via direct contact on the rolling surface of said wheels, embodiments have concerned the addition of discs made of a material, particularly metal, on a lateral surface of the wheels and brake pads carried by an element connected to the frame which is moved in the direction of the discs in order to brake.

A disc braking device for in-line roller skates is disclosed in U.S. Pat. No. 5,657,999. It includes two discs mounted on each side of the two central wheels, two rods rotatably mounted on the frame about an axis of rotation perpendicular to the axles of the two wheels carrying brake pads, a control lever for the rod rotatably mounted under the boot about an axis of rotation parallel to the axles of the wheels, a pedal housed inside the boot so as to be able to actuate the lever and the rods against return means to bring the pads into contact with the discs in order to brake. It can easily be seen that one drawback of such an embodiment lies in the fact that it is necessary for the toes to act on an inner pedal with significant force in order to brake which makes the use of such skates uncomfortable.

WO Patent No. 97/11759 discloses in-line roller skates with a disc braking device actuated using a control lever articulated on the rear of the skate. In an alternative embodiment, the braking device is formed of the control lever connected on one side to the cuff of the boot and on the other side to a rotating brake pad mounted on the axis of rotation of the rear wheel, a braking rod assembly connects this first pad to other brake pads rotatably mounted on the axles of other wheels, one surface of said pads, opposite the contact surface with the wheel, including ramps co-operating with elements projecting inside the frame so that by acting on the control lever, the rotating pads are brought against return springs in the direction of a lateral surface of each of the wheels provided with pads to brake them.

In another variant, two brake rods placed on each side and over the length of the row of wheels at the level of their axis of rotation include longitudinal elongated holes so as to be able to slide on the rotational axles and a certain number of ramps acting as brake pads placed facing each wheel so that by acting on the control lever the rod slides forwards against return means bringing the ramps into contact with a lateral surface of each wheel.

One drawback of such a device is that the braking force is applied directly at the level of the rotational axles of said wheels or on the periphery of said wheels which causes excessively abrupt braking and wears the wheels or brake pads too quickly. This thus does not allow pressure on the discs to be differentiated as a function of the position of the wheels on the skate. These solutions do not offer the possibility of progressive braking and lack flexibility which, as mentioned, results in the wheels locking and premature wear of the rubber of the wheels.

SUMMARY OF INVENTION

Accordingly, one object of the invention consists in overcoming the drawbacks of the aforecited braking devices by providing in-line roller skates comprising a braking device which acts gently and progressively.

This object, in addition to others, is achieved by in-line roller skates including at least three wheels mounted on a frame on which is secured a boot and a braking device which includes a control lever articulated on the skate frame, a lateral rod carrying brake pads guided lengthways on the frame and return means to bring the rod into a rest position, a backwards movement of the boot or leg of a user driving the lever which pushes the rod longitudinally against return means into a wheel braking position, the skate being characterized in that at least one ramp is provided on the guide path of the rod so that, when the brake device is actuated, the rod moves forwards against the return means in the direction of discs mounted on a lateral surface of the wheels to bring the brake pads into contact with the discs, said ramp being mounted on the rod or at least on a guide member of the frame between two axles of neighboring wheels so that the braking force imposed on the brake pads against the disc is applied at a point of the rod in proximity to the ramp, while allowing the rod to bend between the brake pads in contact with the discs to assure gradual braking, and in that the rod carrying the brake pads and guided in the longitudinal direction is placed above the axles of the wheels so that the brake pads touch an upper surface of each disc of the wheels so that at the moment of contact of the pads on the discs, the rotation of the wheels in the direction of movement of the skate can drive the rod forwards in the direction of the wheels, independently of the action of the control lever, via friction of the pads on the discs to assist braking and to cause the rod pads to clamp against the disc.

One advantage of the braking device consists in using the wheels' rotation to drive the rod carrying the brake pads forwards, via friction, against return means, as soon as said pads come into contact with each disc of the wheels, and thus to apply the pads gradually and with more force against the discs to assure self-braking as a result of the movement imposed by the ramps on said rods.

Another advantage of the braking device consists in applying the braking force to the pads at points on the rod located between the axles of two neighboring wheels, and relying on the resilience of the metal rod to assure gentle and gradual braking. In the event that the skate has four wheels, there must be at least two ramps on the rod located between the axles of two neighboring wheels. The first ramp is thus located between the two rear wheels and the second ramp is located between the two front wheels. For a five wheel skate, two rod ramps are used for the three rear wheels, while a third ramp is used between the two front wheels.

One may envisage placing the ramps so as to obtain differential braking. In order to do this, the ramp located between two neighboring wheels may be set off-center, which results in the braking force of the closest pad to the ramp being greater than the braking force of the pad furthest from said ramp.

Braking occurs on discs made, for example, of steel arranged on at least one flank of the wheels via brake pads which are generally made of graphite. An insulating gasket is inserted between this metal disc and the surface of the wheel in order to prevent the heating of the discs during braking being communicated to the wheel rubber. As previously described, it is difficult to brake via the wheels, since the braking power on said wheels has to be apportioned as a function of the possible adherence of the wheels to the ground. This adherence depends on several factors, which are for example the gripping quality of the rubber, the diameter of the wheel, the number of wheels braked, features of the ground and the braking device formed by the material of the discs and pads, and the pressure generating mechanism which must be gradual.

On the other hand, in order to brake via discs, care must be taken not to lock the wheels abruptly, since, in such case, a flat portion is formed on the rolling surface of the wheels which quickly makes them unusable. This also depends on the skater's weight and the size and material of the wheels used. Moreover, account must also be taken of the heating of the discs which can unnecessarily heat the wheels by inserting for example an insulating gasket mentioned hereinbefore. For all these reasons, braking applied to the largest possible number of wheels of the skates provides an additional advantage. By this observation of the advantage of braking on the largest possible number of wheels, braking occurs on all four or five wheels of one of the skates or more if the skate has more wheels.

Braking by scissoring the legs is one of the only ways of maintaining sufficient stability, which allows braking with a single skate, i.e., that of the front leg.

Braking tests with only two wheels have been performed. This method remains acceptable only to slow down on a relatively flat road, which is not possible on a much steeper road. Further, significant wear of the rear wheels occurs, since the gripping possibility of two wheels with respect to the ground wears evenly the wheels the most pressed against the ground. This is why, it is preferable to brake all the wheels of the skate to prevent any surprise resulting from any irregularity in the ground.

BRIEF DESCRIPTION OF THE DRAWINGS

The objects, advantages and features of the in-line skates with their braking device will appear more clearly in the following description of embodiments illustrated by the drawings, in which.

DETAILED DESCRIPTION OF THE PREFERRED EMBODIMENTS

Figure 1:
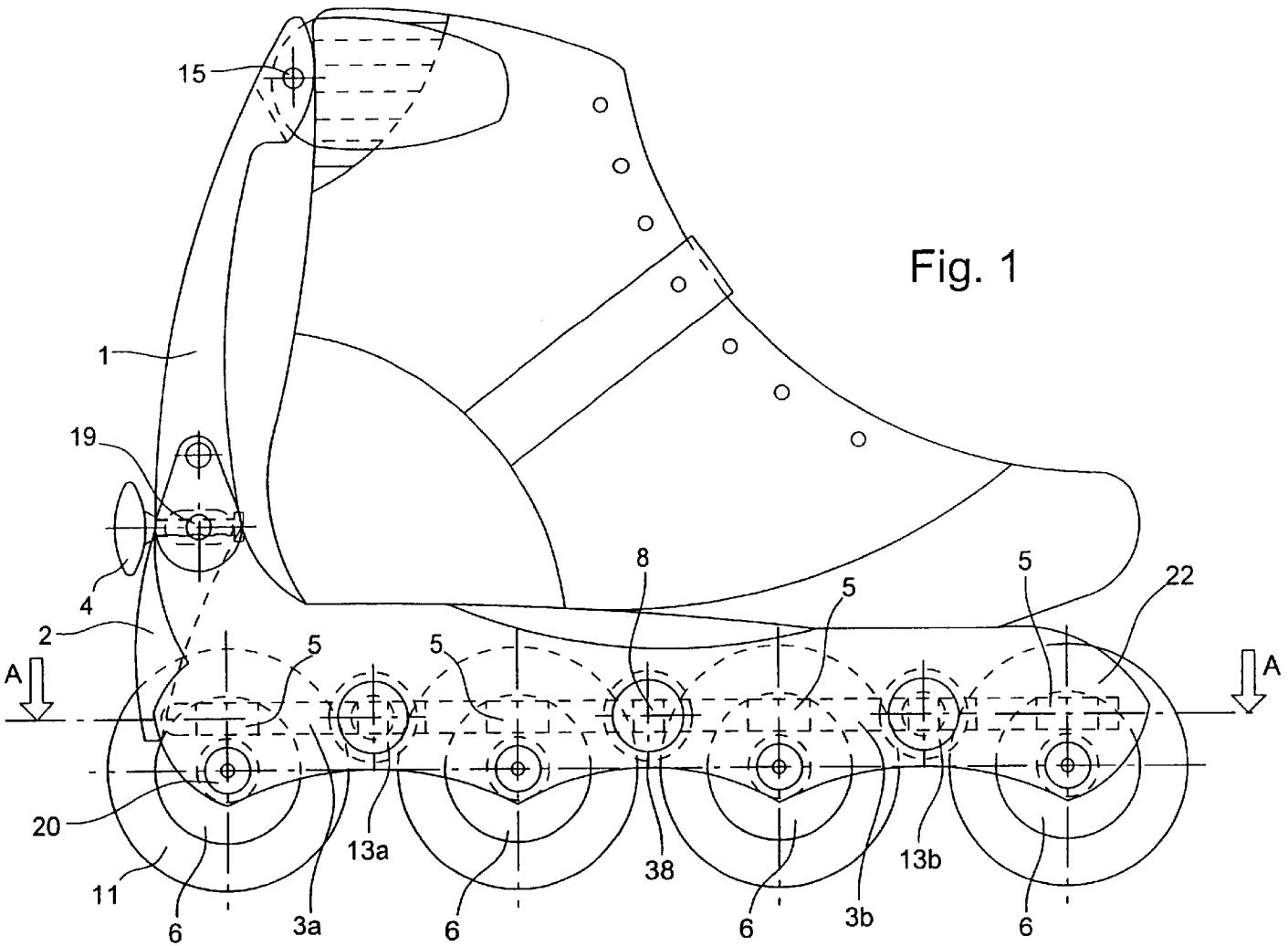
FIG. 1 shows a lateral view of a first embodiment of the roller skate with its braking device according to the invention.

FIG. 1 shows a first embodiment of an in-line roller skate. In this configuration, the skate includes four wheels. Of course, those skilled in the art will understand that the invention is not limited to a precise number of wheels arranged on each skate. Said skate may include three, four, five wheels or more in the case of roller skates used in downhill competition for better stability.

Figure 5:
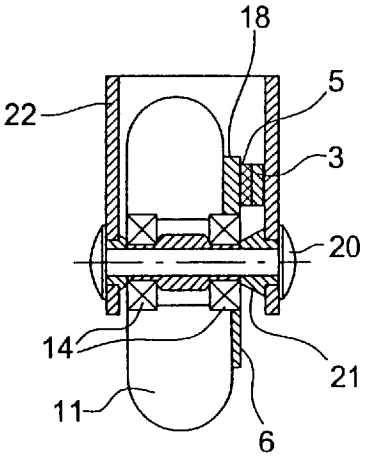
FIGS. 4 to 6 show a partial cross-section along B—B in the vicinity of one of the skate wheels of FIG. 2 with various assembly variants of the disc on the wheel.
Figure 4:
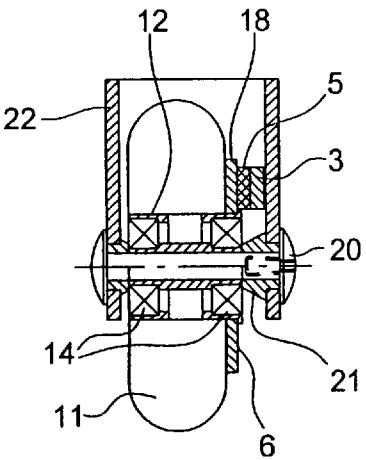
Figure 6:
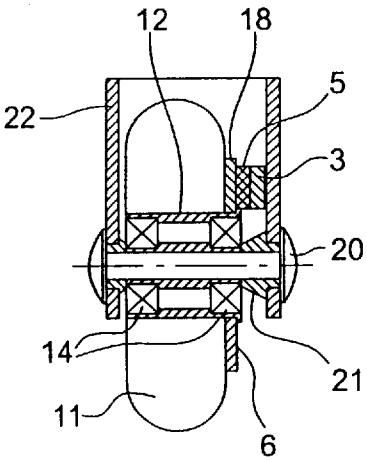

The roller skate includes a boot fixed above a metal frame 22 under which wheels 11 of the skate are disposed between two plates of said frame 22 and held at a distance from the plates by two separator elements 21, which are visible in FIGS. 4 to 6. Wheels 11, made for example of polyurethane, are fixed to the plates of frame 22 by an axle passing into the inner ring or case of a ball bearing. The axle is held fixed to the chassis by a screw-nut arrangement 20. The same is true for the inner ring of the ball bearings or the inner housing keeping them in the wheel as a result of separator elements.

At the rear of the boot, a control lever 1 is rotatably mounted about an axis of rotation 19 on a rear part of frame 22. The upper part of lever 1 is connected in rotation 15 to the cuff of the boot, while its lower part 2 is used to push a lateral rod 3 guided longitudinally on one of the plates of frame 22 and held in the rest position (without braking) against a stop of the frame by return means. An adjusting screw 4 in proximity to the pivot shaft 19 of the lever allows the position of the lever on the frame to be adjusted angularly in order to be able to act on the inclination which the cuff or leg has to have in order to be able to brake sooner or later.

Rod 3, which may be in one piece or in two half-parts 3*a* and 3*b*, as shown in FIG. 1 of the first embodiment of the skate, is formed of a metal material, preferably an aluminum alloy, to be able to guarantee a certain resilience during braking.

Brake pads 5 made for example of graphite, are mounted on the rod in an equal number to the number of metal discs 6, which are preferably made of steel, mounted on a lateral surface of wheels 11. Advantageously, brake pads 5 are four in number, like the number of discs 6 so that all the skate wheels 11 can be braked in order to assure uniform braking over said wheels 11.

Each part or strip 3*a* or 3*b* of the rod includes on the side turned towards the guide plate of chassis 22, a ramp 7*a* or 7*b* which co-operates with a corresponding ramp made in a housing for guide members 13*a* and 13*b* of frame 22. In the rod rest position, ramp 7*a* or 7*b* abuts against a rear stop of each guide member housing. Given that the housing may be shaped to have a complementary shape to ramp 7*a* or 7*b* of the rod, the rod abuts against a stop when its ramp entirely occupies the housing of member 13*a* or 13*b*. In this rest position the face of the rod opposite the plate abuts against said plate of the frame.

Of course, the shape of the housing of guide members 13 and 13*b*, explained hereinbefore, is in no way limited to the complementary shape of ramps 7*a* and 7*b*, and those skilled in the art may imagine various other shapes able to assure guiding of the ramps without departing from the scope of the invention. One may imagine, for example, that the edges of the housing alone are sufficient support for ramps 7*a* and 7*b*. The housing of each guide member may also include the ramp, while the rod only includes projecting elements each coming into contact with the corresponding guide ramp of said members provided that the function of bringing brake pads 5 in the direction of the discs is assured when the rod is moved forward.

Rod 3 carrying brake discs 5 and guided by members 13*a* and 13*b* is placed above the axles of all the wheels so that in the braking position each brake pad 5 abuts an upper surface of disc 6 of each wheel 11. When lever 1 is actuated for braking, rod 3 is pushed forwards and via ramps 7*a* and 7*b* brings the brake pads in the direction of the wheel discs. From the start of braking during friction of the brake pads against the discs, rotation of the discs tends to pull said rod forwards, independently of the lever, and consequently causes pads 5 to abut against said discs 6 with more force, so as to guarantee self-braking while keeping the application of braking force on the pads by the ramps between two neighboring wheels.

In this first embodiment, the two half-parts 3*a* and 3*b* of the rod are connected by a cross-bar 8 housed in a guide element 38 and longitudinally mobile. Each end 9 of half-parts 3*a* and 3*b* is also formed of a ramp abutting against corresponding ramps of cross-bar 8 in order to impose a force on the ends of half-parts 3*a* and 3*b* in the direction of the discs of the wheels when the rod moves forwards during a braking operation.

In the event that a rod in a single piece is used, one may envisage omitting guide member 38 and only providing two ramps for the rod, one of which is placed between the first and second wheels and the other between the third and fourth wheels while still maintaining gentle and gradual braking.

Figure 2:
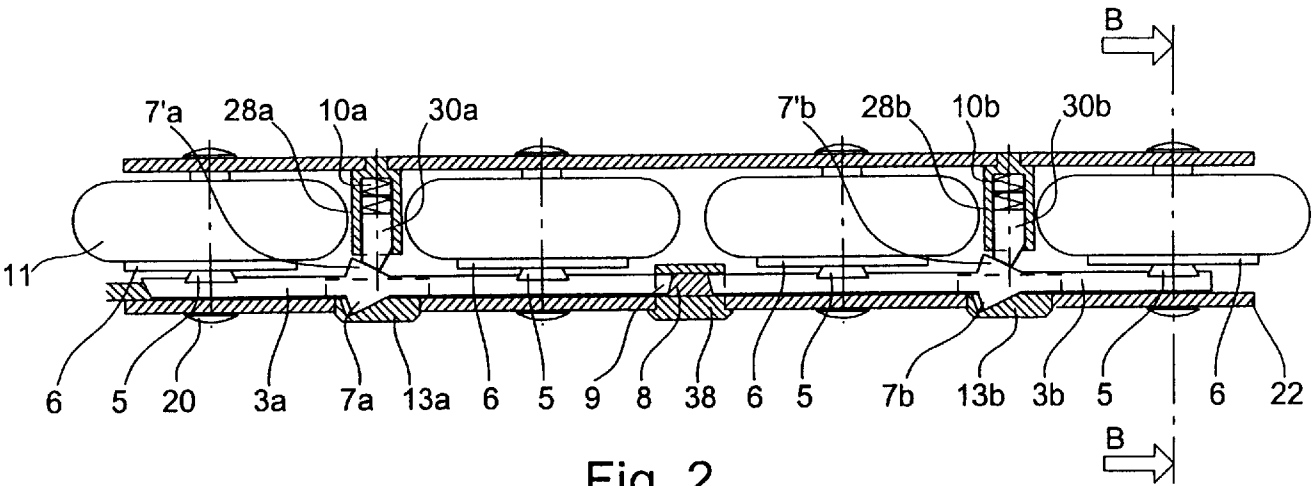
FIG. 2 shows a partial longitudinal cross-section along A—A of the frame of the skate of FIG. 1.

In FIG. 2, the braking device or mechanism, as described previously, includes a rod separated into two half-parts 3*a* and 3*b* with a ramp 7*a* and 7*b* each, a cross-bar 8 between the two half-parts of the rod allowing them to be connected when pushed forwards, causing braking by pressing pads 5 against discs 6.

It is ramps 7*a* and 7*b* and the ends 9 of the rod half-parts 3*a* and 3*b* also made in the shape of a ramp to abut on complementary ramps of cross-bar 8 which cause the pads to be pressed against the discs. Two return springs 100 and 10*b*, guided in tubular parts 28*a* and 28*b* fixed onto a plate of frame 22 facing the plate guiding rod 3*a* and 3*b* each push using a wedge 30*a* and 30*b* abutting on other ramps 7'*a* and 7'*b* opposite to ramps 7*a* and 7*b* for pressing the pads, the rod in the rest position against a stop of frame 22, in particular against a rear part of the housing of guide members 13*a* and 13*b*.

Figure 3:
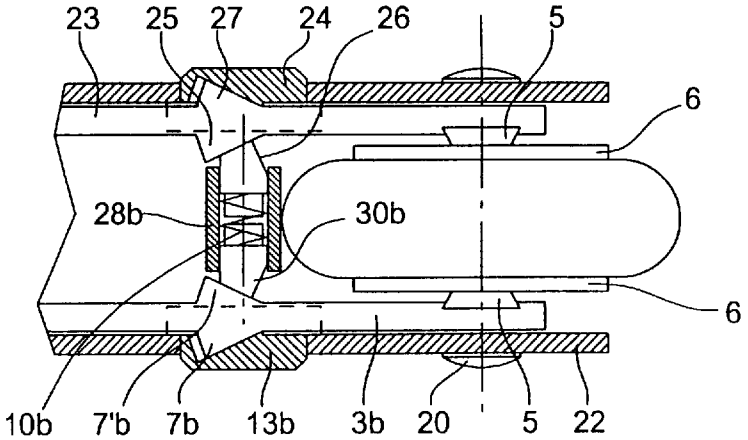
FIG. 3 shows part of the cross-section of FIG. 2 of a variant of the first embodiment with the braking mechanism on both sides of the wheels.

FIG. 3 shows an example of an application of the braking device on both sides of the wheels. Rod 3 operates in an identical way brake to that described previously, the only difference being that both sides of wheels 11 are braked. In this alternative embodiment with two rods 3 and 23, the return springs 10*a* and 10*b* are each housed in a tubular part which does not abut against one of the plates of frame 22 facing ramps for pressing the pads, but it is connected above said ramps to one or both plates by a mechanical connection, which is not visible in FIG. 3.

FIG. 4 shows the mounting of discs 6 on a ball bearing housing 12 in which ball bearings 14 are mounted. As can be seen in FIG. 4, the part of housing 12 supporting disc 6 projects further than the other side of wheel 11. An anti-friction thermal gasket 18 is disposed between disc 6 and wheel 11 to avoid the rubber of wheel 11 overheating during braking friction of pad 5 against metal disc 6. Braking pad 5 can also be distinguished on rod 3 at the start of braking.

Wheel 11 with its ball bearings 14 is placed between two plates of frame 22. The inner part of bearing 14 is held in position between the plates by two elements 21 one of which is of larger dimensions in order to offset the wheel as a function of rod 3 guided on one of the plates of frame 22. A metal axles defining the axis of rotation of wheel 11 with a screw-nut arrangement 20 passes through wheel 11 and elements 21 in order to hold them.

FIG. 5 is a variant which shows disc 6 mounted directly on one of ball bearings 14. Whereas in FIG. 6 showing another variant, disc 6 is mounted on a bearing housing 12 passing entirely through wheel 11.

Figure 7:
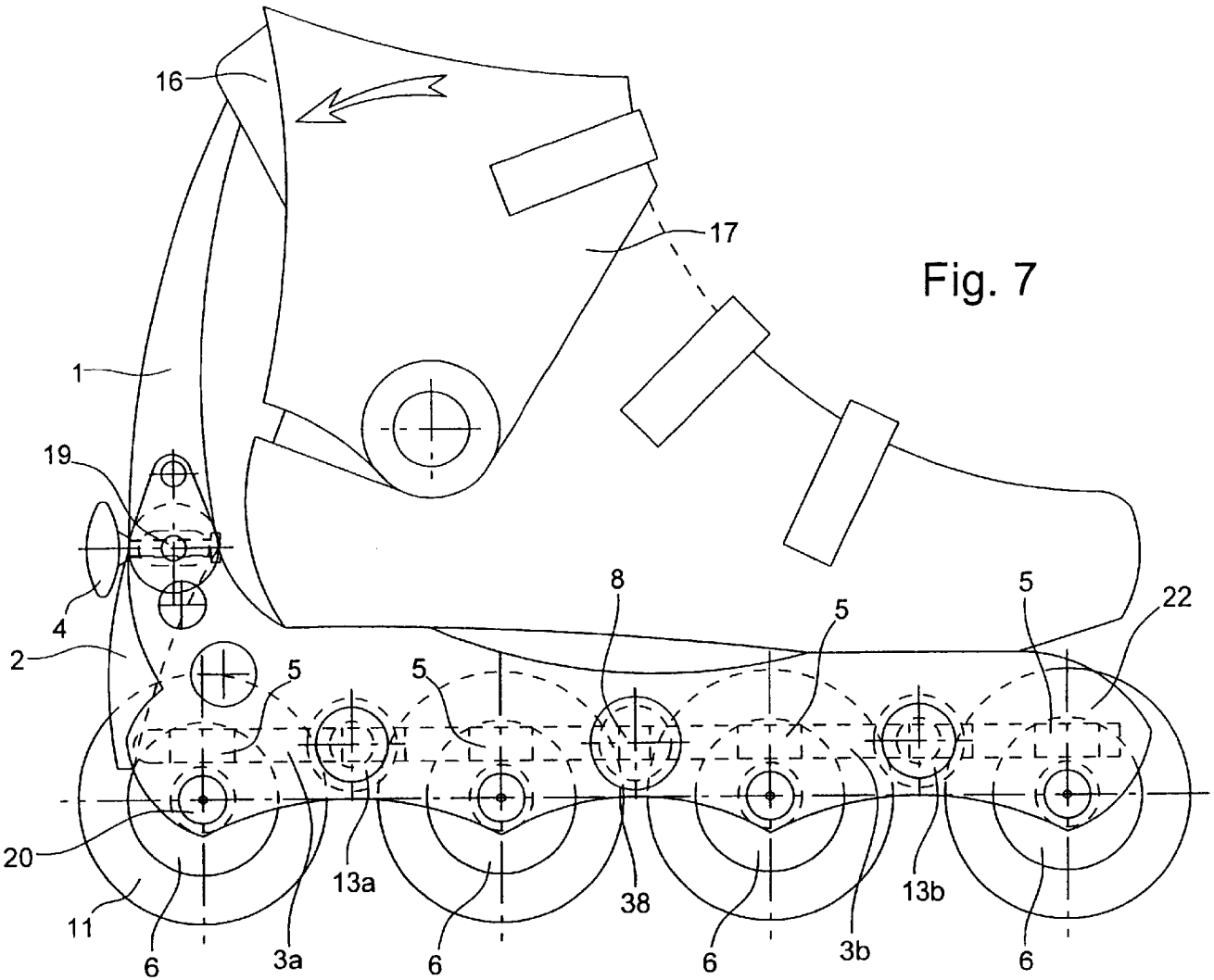
FIG. 7 shows a lateral view of a second embodiment of the roller skate with its braking device according to the invention.

FIG. 7 shows a second embodiment of the in-line roller skate with its braking device. The essential difference with respect to the first embodiment and its variant lies in the fact that the control lever 1 is no longer directly connected to the cuff of the boot, but abuts against a cam 16 which defines an inclined plane. When the upper part of the boot pivots backwards, it drives the lever in rotation about its point of rotation 19 in order to be able to impose a forward movement on rod 3 against return means mainly formed by springs 10*a* and 10*b* each abutting a wedge 30*a* and 30*b* against a ramp 7*a* and 7*b* which are visible in FIG. 2 so that brake pads 5 come into friction contact against discs 6 of wheels 11.

As mentioned above, braking is obtained by moving forward the leg with the skate provided with the braking device so that the legs are in a scissors position. This causes control lever 1 to pivot backwards, which, by pivoting about shaft 19 causes pressure forward of lower part 2 of said lever. In this operation, the two half-rods 3*a* and 3*b* move forwards in the direction of discs 6 of the wheels via their ramps 7*a* and 7*b*, visible in FIG. 2, abutting against corresponding ramps of guide members 13*a* and 13*b* of the plate of frame 22 guiding the rod. Brake pads 5 thus come into contact with discs 6 secured to wheels 11 when rod 3 moves forward.

The longitudinal positioning between the axles of two neighboring wheels of the ramps allows braking pressure differentiation to be assured on each of the wheels, which guarantees a certain flexibility in the application of braking pressure according to one of the objects which the invention wishes to attain.

Figure 9:
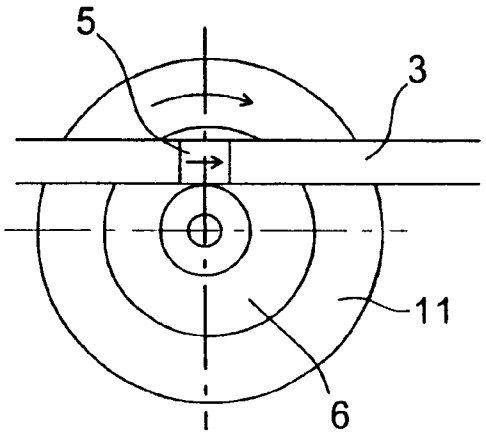
FIGS. 8 and 9 show the self-braking principle of the wheels at the start of braking.
Figure 8:
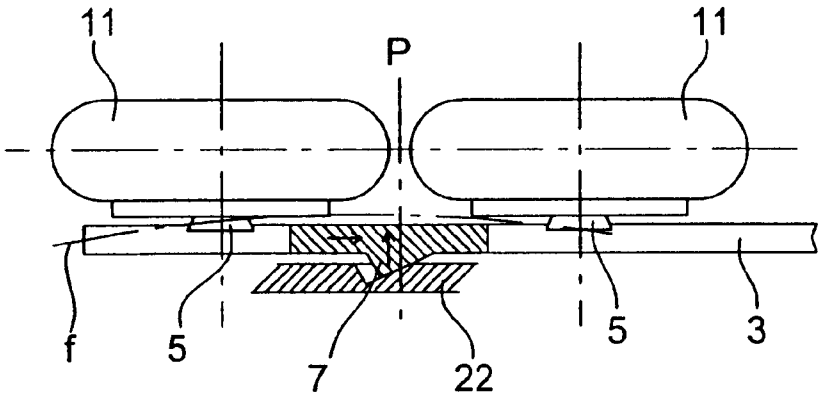

FIGS. 8 and 9 retrace the braking principle in a more explicit manner with the application, between two axles of neighboring wheels 11, of the abutting force of brake pads 5 against the wheel discs 6. When rod 3 moves forwards, ramp 7 following the ramp of a guide member of frame 22 brings brake pads 5 into contact with discs 6 while slightly bending rod 3 in applying force to the point of abutment of the ramp on the guide member. Curve f of FIG. 8 shows the bending of the rod at point p of the application of braking force in a slightly exaggerated manner. Further, since the friction of the brake pad advantageously occurs on an upper part of disc 6 of the wheel, the rotation of said wheel still drives the rod forwards, which assures self-braking independently of any actuation of the control lever.

One may also envisage offsetting force application point p in the direction of one or the other of the axles of the neighboring wheels to be able to obtain thereby a differentiation in the braking force on one or other of said wheels.

Figure 10:
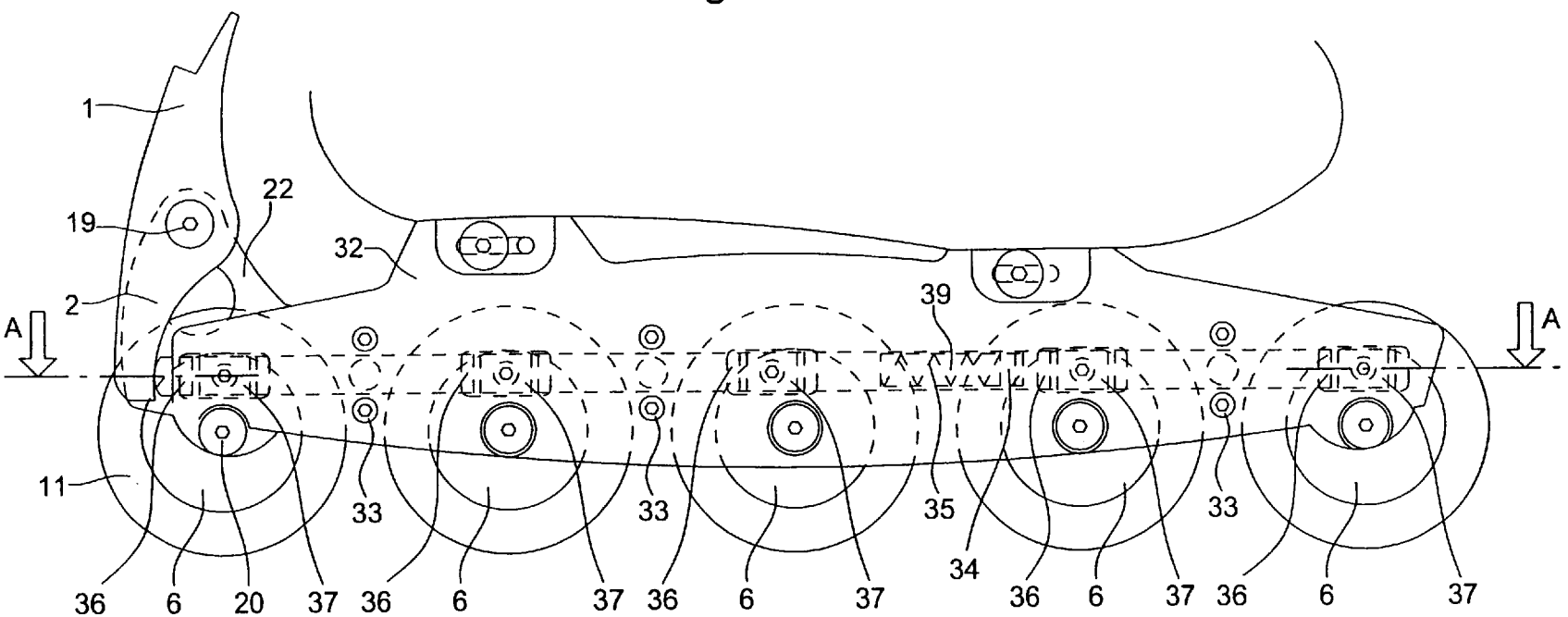
FIG. 10 shows a lateral view of a third embodiment of the roller skate with its braking device according to the invention.
Figure 12:
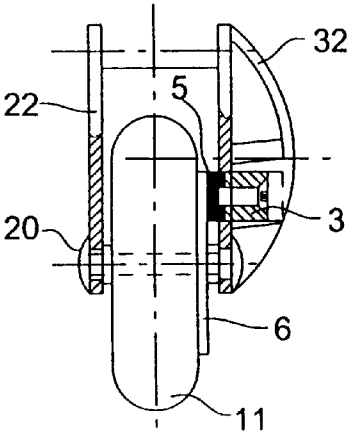
FIG. 12 shows a partial cross-section along B—B in the vicinity of one of the wheels of the skate of FIG. 11.
Figure 11:
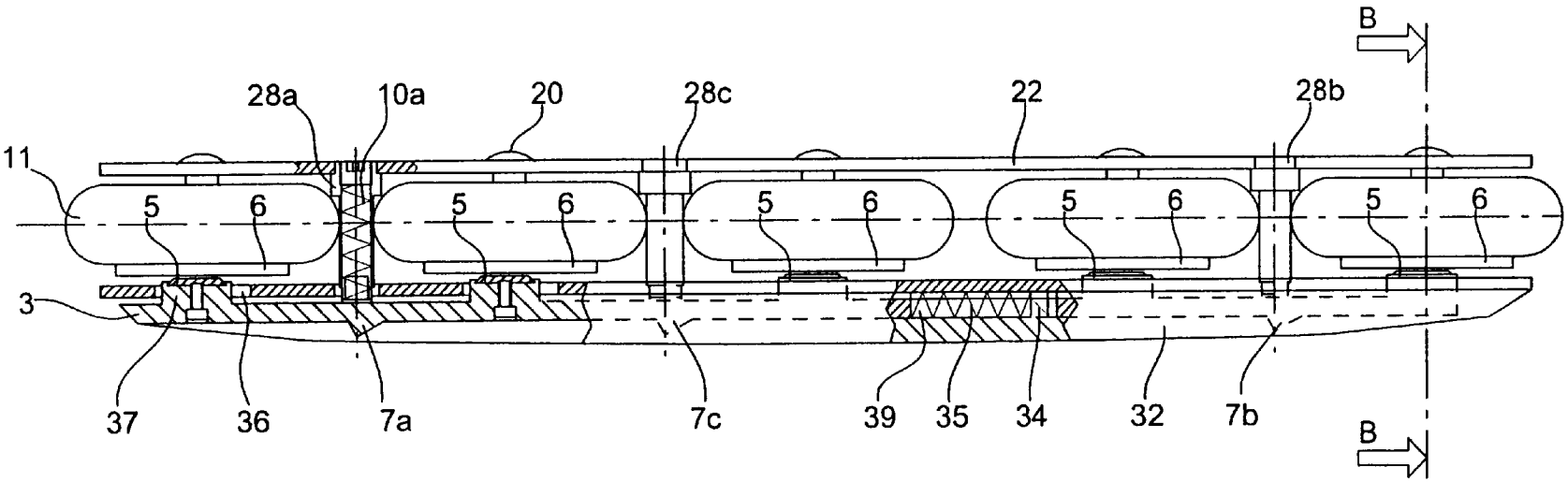
FIG. 11 shows a partial longitudinal cross-section along A—A in the vicinity of the frame of the skate of FIG. 10.

FIGS. 10 to 12 show a third embodiment of the in-line roller skate with a similar braking device to that explained above. All the elements which are identical to those shown in FIGS. 1 to 7 carry the same reference signs. The description of this third embodiment will only explain the main differences between roller skates provided with a braking device which includes five wheels essentially for downhill sporting competitions for example in order to have better stability.

A plate 32 is added and screwed by screws 33 to one of the plates of frame 22 in order to be able to guide a rod 3 carrying brake pads 5 using a longitudinal groove. The rod in this third embodiment is thus located on the outer side of one of the plates of frame 22 between which are placed wheels 11 so as to be able to change worn brake pads easily simply by removing plate 32 without having to remove the wheels during such change. It is to be noted that the brake pads are worn out much more quickly in downhill competitions; this is why they have to be easy to change. Since the rod slides in a longitudinal groove made in plate 32 and it is located on an outer side of the plates of the frame, elongated holes 36 are machined in the plates of frame 32 on the side of plate 32 allowing protuberances 37 of rod 3 which carries brake pads 5, to pass. The width of the elongated holes must be such that it allows the rod to be able to slide lengthways between at least a rest position and a braking position.

A spring 35 for returning the rod into the non-braking rest position is placed in a housing 39 made over a length of rod 3 and abuts against a stop 34 of the plate secured to frame 22. The return force of the rod is directed longitudinally in this third embodiment. Springs 10 housed in tubular parts 28*a* to 28*c* are used only to push the rod into the guide groove of plate 32.

Since the skate includes five wheels, three ramps are provided for applying the force in a uniform manner over all the wheels. The first two ramps 7*a* and 7*c* are intended for the three rear wheels, while the third ramp 7*b* is intended for the two front wheels. Said ramps 7*a* to 7*c* abut in housings including complementary ramps made along guide grooves of the plate.

From the description which has just been made, multiple embodiments may be provided without departing from the scope of the invention and within the grasp of those skilled in this technical field.

What is claimed is:

1. An in-line roller skate including at least three wheels mounted on a frame on which is secured a boot and a braking device which includes a lateral rod carrying brake pads for coming into contact with discs mounted on a lateral surface of the wheels during a braking operation, said rod being guided lengthways on the frame, return means to bring the rod into a rest position, and a control lever articulated on the skate frame, a backward movement of the boot or leg of a user allowing the lever to push the rod longitudinally forwards against return means into a wheel braking position, wherein at least one ramp on a guide path of the rod is mounted on the rod or at least on a guide member of the frame between two axles of neighboring wheels for bringing said brake pads into contact with said discs when the rod moves forwards against said return means so that the braking force imposed on the brake pads against the discs of said neighboring wheels is applied at a point of the rod in the ramp region, the rod being resilient in order to be able to bend between the brake pads in contact with the discs of said neighboring wheels to assure gradual braking, and wherein the rod carrying the brake pads is placed above axles of the wheels so that the brake pads touch an upper surface of each disc of the wheels so that at the moment of contact of the pads on the discs, the rotation of the wheels in the direction of movement of the skate can drive the rod forwards in the direction of the wheels, independently of the action of the control lever, via friction of the pads on the discs to assist braking and to cause the rod pads to clamp against the disc.

2. The skate according to claim 1, wherein it includes four wheels each with a disc on a lateral surface, and wherein two ramps are mounted on the rod in contact with abutting elements of the guide members of the frame, the first ramp being disposed between two rear wheels, while the second ramp is positioned between the two front wheels.

3. The skate according to claim 1, wherein it includes two lateral rods on both sides of the wheels, the brake pads of each rod each coming into contact with a disc placed on each side of the wheels, when the rod moves forwards.

4. The skate according to claims 2 or 3, wherein the rod is separated into two rod half-parts, each half-part being provided with one of the two ramps.

5. The skate according to claim 4, wherein the connection of the two rod half-parts is assured by a cross-bar housed so as to move longitudinally in a guide member placed between the second and third wheel, one of the ends of each rod half-part coming into contact with an inclined surface of the cross-bar so that, when the rod moves forward, the ends of the rod half-parts in contact with the cross-bar undergo a force in the direction of the wheels.

6. The skate according to claim 2, wherein each abutting element of the guide members is a housing having a complementary shape to the ramps of the rod to allow a stop to be provided for the rod in a rest position and to guide the rod in the direction of the wheels during braking.

7. The skate according to claim 1, wherein the ramp or ramps are positioned between the axles of neighboring wheels as a function of the braking pressure values to be attributed to one and the other of the neighboring wheels.

8. The skate according to claim 1, wherein said skate includes five wheels disposed between two plates of the frame each with a disc on a lateral surface, wherein a longitudinal guide plate for the rod is mounted externally on one of the frame plates, wherein the rod has protuberances each carrying a brake pad to come into contact with the discs of the wheels and passing through elongated holes made in the plate of the frame on the plate side, the width of the elongated holes being greater than the width of the protuberances to allow the rod to make a longitudinal forward movement in the direction of the wheels during braking, and wherein three ramps are mounted on the rod in contact with the abutting elements of the guide members of the frame plate, the first and second ramps each being disposed between the axles of the three rear wheels, while the third ramp is positioned between the two front wheels.

9. The skate according to claim 1, wherein the return means are formed by a tubular part secured to the frame housing a spring acting parallel to the axes of the wheels and ending in at least one wedge abutting another ramp mounted on the opposite side to the braking force application ramp to push the rod into a rest position.

10. The skate according to claim 1, wherein the return means are formed by a spring housed in a longitudinal opening of the rod abutting against a stop of the frame to push the rod into a rest position.

11. The skate according to claim 1, wherein an anti-friction and thermal gasket is placed between each disc and the corresponding lateral surface of the wheels in order to prevent the wheel rubber overheating during braking.

12. The skate according to claim 1, wherein an adjusting screw is provided to move the point of rotation of the lever in order to adjust the braking action of the lever on the rod.

13. An in-line roller skate including at least three wheels mounted on a frame on which is secured a boot and a braking device which includes:

a lateral rod carrying brake pads for coming into contact with discs mounted on a lateral surface of the wheels during a braking operation, said rod being guided lengthways on the frame, return means to bring said rod into a rest position, and a control lever articulated on the skate frame, a backward movement of the boot or leg of a user allowing the lever to push the rod longitudinally forwards against return means into a wheel braking position, wherein at least one ramp on a guide path of the rod is mounted on the rod in contact with at least one abutting element of guide members of the frame between two axles of neighboring wheels for bringing said brake pads into contact with said discs when the rod moves forward against said return means so that the braking force imposed on the brake pads against the discs of said neighboring wheels is applied at a point of the rod in the ramp region, the rod being resilient in order to be able to bend between the brake pads in contact with the discs of said neighboring wheels to assure gradual braking, wherein the rod carrying the brake pads is placed above axles of the wheels so that the brake pads touch an upper surface of each disc of the wheels so that at the moment of contact of the pads on the discs, the rotation of the wheels in the direction of movement of the skate can drive the rod forwards in the direction of the wheels, independently of the action of the control lever, via friction of the pads on the discs to assist braking and to cause the rod pads to clamp against the disc, and wherein said abutting element of the guide members is a housing having a complementary shape to the ramp of the rod to allow a stop to be provided for the rod in a rest position and to guide the rod in the direction of the wheels during braking.

14. The skate according to claim 13, wherein it includes four wheels each with a disc on a lateral surface, and wherein two ramps are mounted on the rod in contact with abutting elements of the guide members of the frame, the first ramp being disposed between two rear wheels, while the second ramp is positioned between the two front wheels.

* * * * *